United States Patent [19]

Cheong et al.

[11] 4,328,861

[45] May 11, 1982

[54] LOUVRED FINS FOR HEAT EXCHANGERS

[75] Inventors: Alex S. Cheong; Richard P. Beldam, both of Mississauga, Canada

[73] Assignee: Borg-Warner Corporation, Chicago, Ill.

[21] Appl. No.: 50,924

[22] Filed: Jun. 21, 1979

[51] Int. Cl.[3] ..... F28D 1/02; F28D 1/32

[52] U.S. Cl. ..... 165/151; 165/153

[58] Field of Search ..... 165/151, 152, 153

[56] References Cited

U.S. PATENT DOCUMENTS

| | | | |
|---|---|---|---|
| 1,862,219 | 6/1932 | Harrison | 165/152 |
| 1,887,036 | 11/1932 | Modine | 165/151 |
| 2,006,649 | 7/1935 | Modine | 165/151 |
| 2,032,065 | 2/1936 | Modine | 165/151 |
| 2,703,226 | 3/1955 | Simpelaar | 165/153 |
| 2,789,797 | 4/1957 | Simpelaar | 165/170 |
| 3,003,749 | 10/1961 | Morse | 165/152 |
| 3,380,518 | 4/1968 | Canteloube et al. | 165/171 |
| 3,397,741 | 8/1968 | Gunter | 165/152 |
| 3,438,433 | 4/1969 | Gunter | 165/151 |
| 3,650,233 | 3/1972 | Young et al. | 113/1 C |
| 3,993,125 | 11/1976 | Rhodes | 165/153 |
| 4,067,219 | 1/1978 | Bianchi | 113/1 C |

FOREIGN PATENT DOCUMENTS

| | | | |
|---|---|---|---|
| 1958909 | 6/1971 | Fed. Rep. of Germany | 165/151 |
| 1521499 | 4/1968 | France | 165/151 |
| 79289 | 5/1955 | Netherlands | 165/109 |

*Primary Examiner*—Sheldon J. Richter

*Attorney, Agent, or Firm*—James A. Geppert

[57] ABSTRACT

A heat exchanger utilizing a tube and fin core or a plate-fin separator wherein a plurality of tubes or plates are arranged in one or more rows with either corrugated fins between the tubes or a stack of horizontal split plate fins have openings receiving the tubes. The fins overhang the row or rows of tubes at the leading and/or trailing edges and have louvres formed therein, with the louvres in the overhanging portion being progressively shortened from the outer edge of the fin. In addition, the louvre at the leading and/or trailing edge of the fin is oriented substantially parallel to the fin surface and the direction of bulk air flow through the core.

12 Claims, 10 Drawing Figures

LOUVRED FINS FOR HEAT EXCHANGERS

BACKGROUND OF THE INVENTION

A heat exchanger for the cooling system of an internal combustion engine for an automotive vehicle utilizes an inlet tank or header and an outlet tank or header connected by a radiator core to provide for either downflow or crossflow circulation of the coolant between the tanks. The inlet tank normally has a coolant inlet, a supply and overflow fitting for a pressure cap, and an overflow conduit, and the outlet tank has a coolant outlet. The radiator core comprises a plurality of parallel spaced tubes extending either vertically or horizontally between the inlet and outlet tanks and a plurality of convoluted fins located in the spacing between the tubes.

In the alternative, a stack of horizontally or vertically oriented flat plate-type fins may form the core with the generally vertical or horizontal tubes, respectively, wherein each fin has a plurality of openings receiving the tubes therethrough. Either type of fin is in contact at a plurality of points with the tubes to provide heat transfer from the hot fluid passing through the tubes to air circulating between the tubes and around the fins; the fins acting to increase the surface area in contact with the air stream and enhance the heat transfer. Also, the convoluted fins may be utilized in a plate-fin separatar type of heat exchanger.

To further improve the heat transfer characteristics of the heat exchanger, the fins have been formed with opening, tabs or louvres to increase turbulance of the air stream passing through the radiator core. The louvres act to increase the heat transfer from the fins to the air flowing around the tubes and fins. In substantially all radiator cores, whether of the corrugated fin or of the slit plate fin type, there is an overhang of the fin beyond the row or rows of tubes. When the slitting of the louvres stops close to the edge of the fin in the overhanging portion beyond the tubes, the heat flow to the overhanging fin portion is restricted. The present invention provides fin and louvre designs to overcome this problem.

SUMMARY OF THE INVENTION

The present invention relates to an improved form of fin and louvre design in a radiator core to increase the effectiveness of heat transfer from the tubes to the fins. To accomplish the increased heat dissipation capability in the overhanging portion of the fin, the louvre length is shortened for the louvres adjacent each end of the fin in the overhang to increase the cross sectional area of fin material through which the heat must pass. Thus, substantially all the louvres in the fin within the extent of the tubes in a row or rows are of a constant length. However, beginning with approximately the last louvre between a pair of adjacent tubes, this louvre is substantially shorter than the length of the normal louvre, and the succeeding louvres on the overhang are progressively longer, but not as long as normal louvres.

The present invention also comprehends the provision of a louvred fin where the leading and/or trailing louvres are oriented at a different angle of attack to bulk air flow than the remaining louvres to reduce the entrance and exit air pressure losses in the radiator core. It is a general practice to have all louvres on a fin formed at a constant angle to the fin surface. This invention utilizes a louvre oriented substantially parallel to the direction of bulk air flow at the leading and/or trailing edges of the fin. Consequently, the entrance and exit pressure loss will be reduced, allowing more air to pass through the heat exchanger and increasing the heat dissipation capability.

Further objects are to provide a construction of maximum simplicity, efficiency, economy, and ease of assembly, and such further objects, advantages and capabilities as will later more fully appear and are inherently possessed thereby.

DESCRIPTION OF THE PREFERRED EMBODIMENTS

Figure 1:
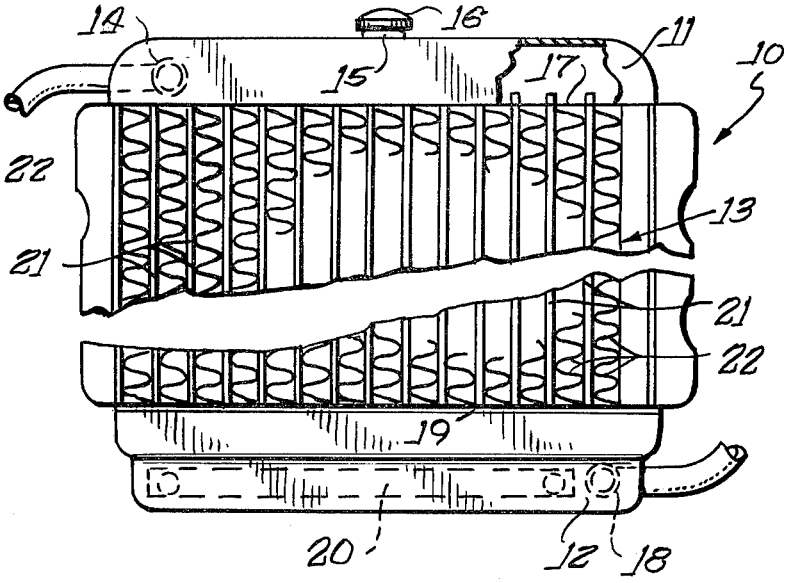
FIG. 1 is a front elevational view of an automobile radiator employing a parallel tube and corrugated fin design.

Referring more particularly to the disclosure in the drawings wherein are shown illustrative embodiments of the present invention, FIG. 1 discloses a conventional heat exchanger in the form of an automobile radiator 10 utilized in the coolant system for an internal combustion engine of an automotive vehicle, wherein the radiator is of the downflow type having an upper or inlet tank 11 and a lower or outlet tank 12 connected together by a radiator core 13. The upper tank 11 includes a coolant inlet 14 from the vehicle engine, a coolant supply and overflow fitting 15 with a pressure cap 16, and a tube header 17 having a plurality of openings to receive the upper ends of the tubes 21 of the radiator core forming the lower wall of the tank. The lower tank 12 has a coolant outlet 18 leading to a fluid pump (not shown) for the engine, a tube header 19 forming a wall of the tank and receiving the lower ends of the tubes 21, and a water to oil cooler 20 within the tank with appropriate fittings to receive transmission oil.

Figure 2:
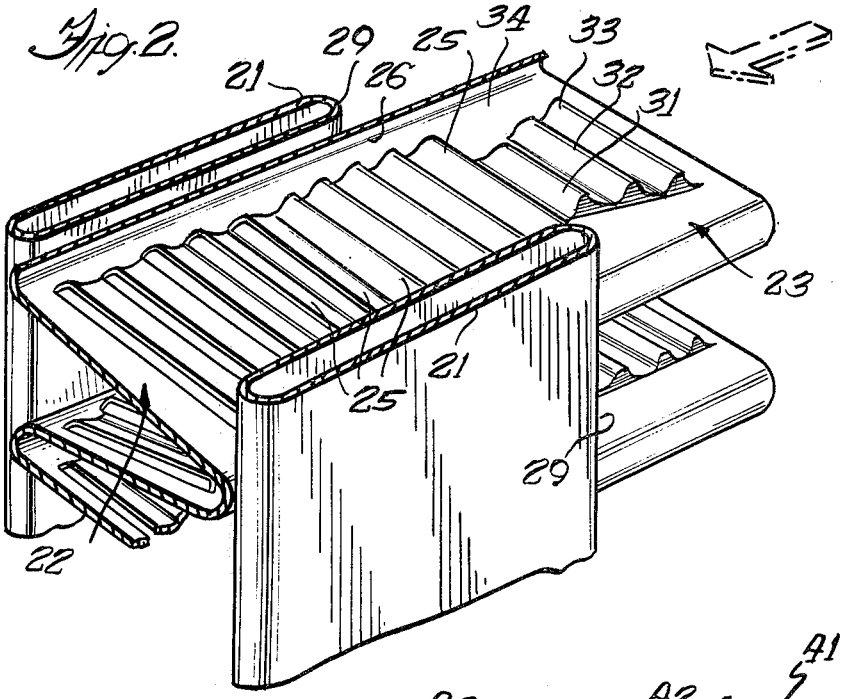
FIG. 2 is a partial perspective view of a single row of tubes and corrugated fin of the core utilizing the present invention.

The radiator core 13 includes one or more rows of elongated narrow tubes 21 as seen in FIG. 2; an automotive vehicle normally utilizing one row of tubes, but for larger vehicles, such as trucks and off-the-road equipment two or more rows of tubes may be necessary for adequate coolant flow. As seen in FIGS. 1 and 2, the spaces between the parallel tubes 21 receive corrugated fins 22 which extend transversely and longitudinally between the tubes from the front surface to the rear surface of the radiator and between the headers 17 and 19. The fins normally have an overhanging portion 23 extending beyond the front and rear edges of the tubes 21. To enhance the heat dissipation characteristics of the radiator core, the fins are slit to provide louvres 25 acting to increase turbulance of the air flow through the core 13; the louvres remaining integral with the fins at the edges 24.

Figure 3:
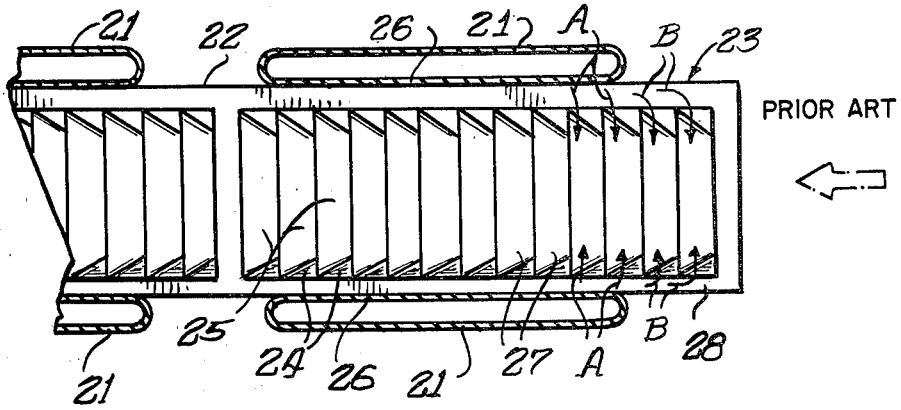
FIG. 3 is a partial top plan view of a conventional fin and tube core using a double row of tubes.

In order to optimize the heat dissipation capability, it is a general practice to use the longest possible louvre without splitting the fin into pieces. As seen in FIG. 3, where all of the louvres 25 are slit to have the same length, heat flow passes from a tube 21 to the fin at a contacting edge 26 and between the louvres at 27 and then to the louvres 25 as shown by the arrows A. As the slitting of the louvres terminates adjacent the edge 26, the heat flow to the overhanging portion 23 of the fin, that is, the portion not attached or contacting the water tube 21 is restricted as shown by the arrows B. Thus, the area 28 between the end of the louvre 25 and the edge 26 of the fin is very limited for heat transference.

Figure 4:
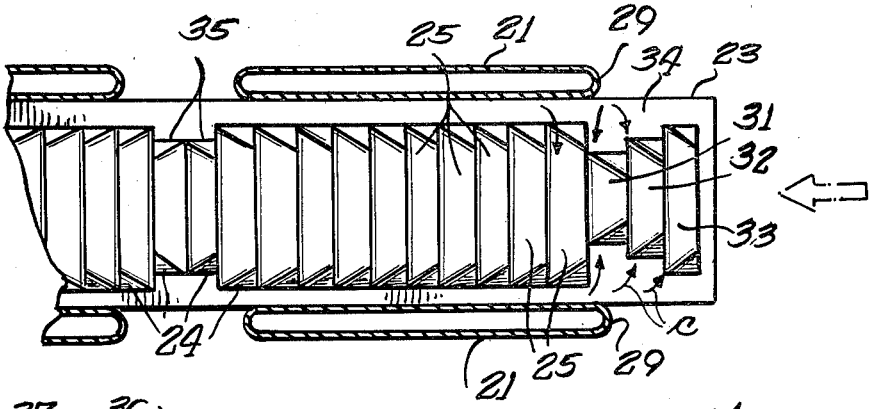
FIG. 4 is a partial top plan view of a double tube and fin core with the variable length louvre design on the fin.

To overcome the restricted heat transfer area in the overhanging portion 23, the last two or three louvres on the fin from the edges 29 of the tubes 21 through the overhanging portion 23 are shortened compared to the length of the louvres 25 (FIG. 4). The last louvre 31 adjacent the tube edges 29 is shortened to approximately one-half to two-thirds the length of louvre 25; the next adjacent louvre 32 is longer than louvre 31; and the last louvre 33 on the fin is longer than louvre 32 but shorter than louvre 25. Depending on the extent of the overhang, only louvres 31 and 33 may be necessary, with louvre 32 omitted. Also, shortened louvres 35 are formed in the fin in the area between the tubes 21.

The amount of shortening for each individual louvre depends on the amount of overhanginag fin. As a general rule, the length of the unslit portion of the fin overhanging portion should equal the number of louvres downstream of the heat flow path multiplied by the louvre width. This should apply to both symmetrical configurations with overhang at both ends and asymmetric configurations with overhang at one end only. As seen in FIG. 4, the shortened fins 31, 32 and 33 provide an enlarged heat transfer area 34 so that the heat flow shown by arrows C is not restricted. Thus, the heat dissipation capability in the overhanging portion is increased by increasing the cross section of fin material through which heat must pass.

Figure 5:
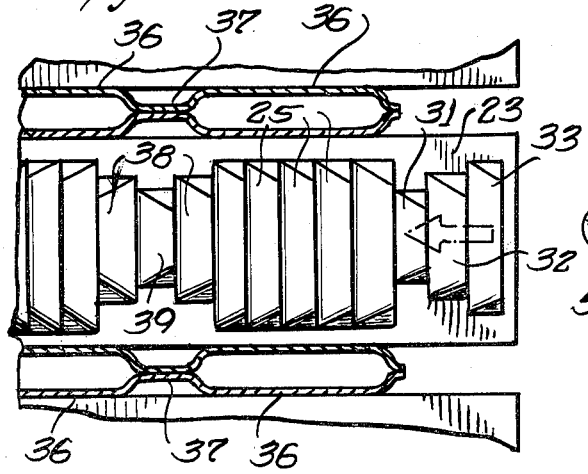
FIG. 5 is a partial cross sectional view through a plate-fin separator type of heat exchanger.

FIG. 5 discloses the same fin structure 22 used with a plate-fin separator type of heat exchanger. In this arrangement, the plate is formed from a single sheet bent over or two sheets abutting to provide tubes 36 joined by a central portion 37. The fin included the progressively shortened louvres 33, 32 and 31 at the overhanging portion 23 and shortened louvres 38, 39 between the tubes 36 opposite the central portion 37.

Figure 6:
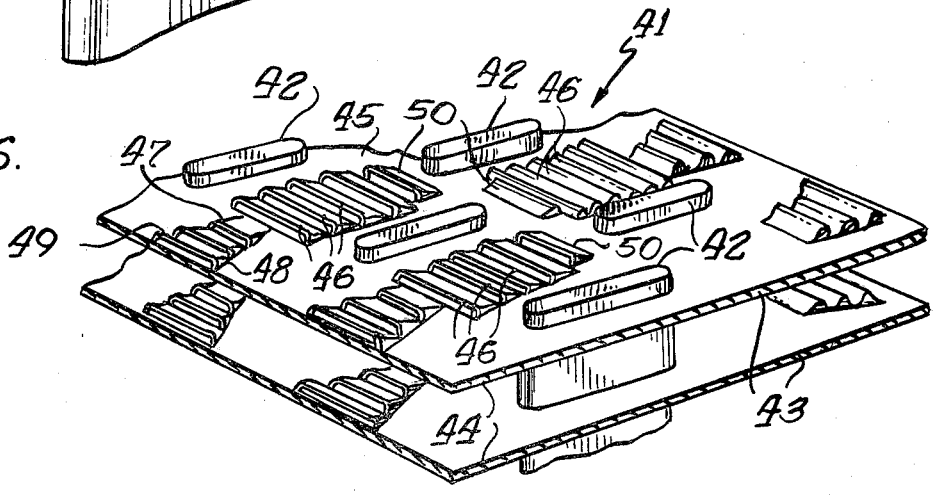
FIG. 6 is a partial perspective view of a split plate fin and multiple rows of tubes for a radiator core utilizing the present invention.

As seen in FIG. 6 the same principle is utilized in a slit plate fin and tube heat exchanger. Only a portion of the radiator core 41 is shown with two rows of generally parallel tubes 42 extending perpendicularly through a plurality of closely stacked horizontal plate fins 43. The plate fins 43 have overhanging portions 44 beyond the rows of tubes 42 as well as portions 45 extending between the rows of tubes. Each fin has a plurality of rows of louvres 46 therein between adjacent tubes in a row, and shortened fins 47, 48 and/or or 49 in each overhanging portion 44 and intermediate fins 50 in each connecting portion 45.

Figure 8:
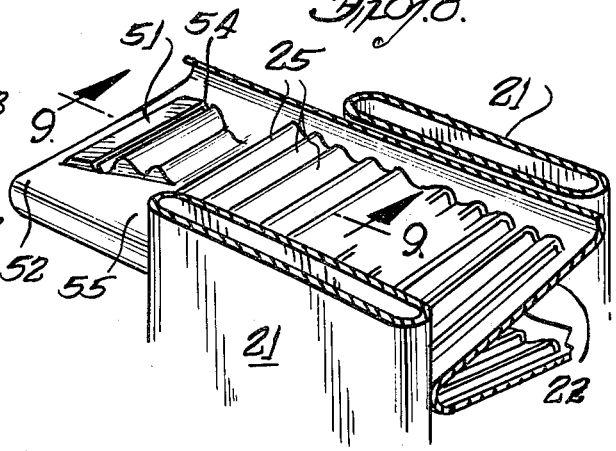
FIG. 8 is a partial perspective view of a tube and fin core showing an additional louvre design.
Figure 7:
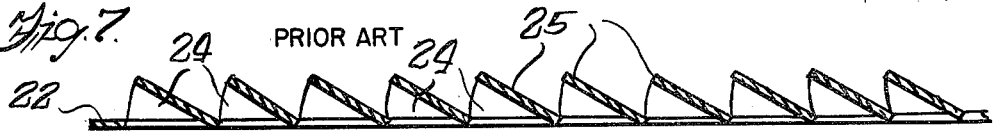
FIG. 7 is a cross sectional view taken through a fin showing a conventional louvre orientation.
Figure 9:
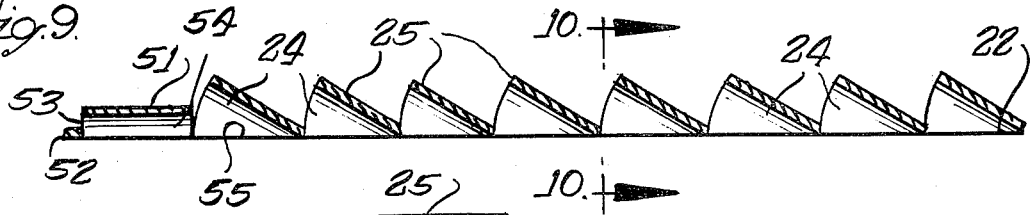
FIG. 9 is a cross sectional view taken on line 9—9 of FIG. 8 showing the improved louvre orientation
Figure 10:
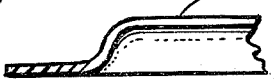
FIG. 10 is a vertical cross sectional view taken on the line 10—10 of FIG. 9.

A further concept of the present invention relates to the orientation of the louvres 25 in the fin 22. As seen fin FIG. 7, it is a general practice to have all louvres 25 formed at a constant angle to the fin surface. To increase the heat dissipation capability of the tube and fin structure, the louvre 51 at the leading and/or trailing edge 52 of the fin is oriented substantially parallel to the direction of bulk air flow through the fin (see Fig. 9). This louvre 51 is raised above the fin surface 55 for approximately one-half the height of a louvre 25 to provide an elongated opening 53 with the side edges 54 of the louvre remaining integral with the fin surface 55 (FIG. 8). Consequently, the entrance and exit pressure loss across the fin will be reduced, hence allowing more air to pass through the heat exchanger or radiator.

Obviously, the shortened louvres may be utilized alone or with the louvre oriented substantially parallel to the direction of bulk air flow to increase the heat dissipation capability of the heat exchanger fins. Likewise, the improvement in louvre orientation may be used alone without the shortened louvres in the fin overhang. Although shown for use in specific types of automobile radiators, we do not wish to be limited to the type of heat exchanger utilizing fins with louvres embodying the present invention.

We claim:

1. In a heat exchanger of the tube and fin core or plate-fin separator type including at least one row of flat tubes and wherein the fins are provided with louvres extending longitudinally parallel to the row of tubes and have an overhanging portion beyond the row of tubes, the improvement comprising at least one row of longitudinally shortened louvres, each louvre in said row of longitudinally shortened louvres shorter than the length of the normal louvres located between adjacent tubes in the row and said row of longitudinally shortened louvres formed in the overhanging portion of the fin adjacent the outer edge thereof beyond the edges of the row of tubes.

2. A heat exchanger as set forth in claim 1, wherein said fins are corrugated.

3. A heat exchanger as set forth in claim 1, in which said fins are split plates having openings receiving said tubes and louvres formed therebetween.

4. A heat exchanger as set forth in claim 1, wherein all of the louvres on a fin surface are oriented at the same angle to the surface.

5. A heat exchanger as set forth in claim 1, wherein the leading and/or trailing edge louvres on a fin are substantially parallel to the fin surface and to the bulk air flow through the fins.

6. A heat exchanger as set forth in claim 1, wherein said fins are located in the spaces between a single row of generally parallel tubes.

7. A heat exchanger as set forth in claim 1, wherein said tubes are positioned in two or more parallel rows.

8. A heat exchanger as set forth in claim 7, wherein the fin area between the rows of tube include shortened louvres therein.

9. in a heat exchanger of the tube and fin core or plate-fin separator type including at least one row of flat tubes and wherein the fins are provided with louvres extending longitudinally parallel to the row of tubes and have an overhanging portion beyond the row of tubes, the improvement comprising progressively longitudinally shortened louvres formed in the overhanging portion from adjacent the outer edge thereof to a point substantially aligned with the edges of the row of tubes, in which the length of the louvre adjacent the outer edge of the fin is slightly shorter than the length of the normal louvres located between adjacent tubes in a row, and a second louvre shorter in length than said outer louvre is positioned between the normal louvres and said outer louvre.

10. In a heat exchanger of the tube and fin core or plate-fin separator type including at least one row of tubes and wherein the fins are provided with louvres extending longitudinally parallel to the row of tubes and have an overhanging portion beyond the row of tubes, the improvement comprising progressively longitudinally shortened louvres formed in the overhanging portion of the fin from the outer edge thereof to a point substantially aligned with the edges of the row of tubes, the length of the louvre adjacent the outer edge of the fin being slightly shorter than the length of the normal louvres located between adjacent tubes in a row, a second louvre adjacent to and shorter in length than the outer louvre, and a third louvre located between said second louvre and the normal louvres and shorter in length than said second louvre.

11. In a heat exchanger of the tube and fin or plate-fin separator type wherein the fins are provided with louvres and have an overhanging portion extending beyond the rows of tubes, the improvement comprising that all louvres except the louvre at the leading and/or trailing edge of the fin are oriented at an identical acute angle to the fin surface and the louvre at the leading end/or trailing edge of the fin is oriented substantially parallel to the fin surface and to the direction of bulk air flow through the fins.

12. In a heat exchanger of the tube and fin or plate-fin separator type wherein the fins are provided with louvres and have an overhanging portion extending beyond the rows of tubes, the improvement comprising that all louvres except the louvre at the leading and/or trailing edge of the fin are oriented at an identical angle to the fin surface and the louvre at the leading and/or trailing edge of the fin is formed substantially parallel to the fin surface and to the direction of bulk air flow through the fins, an elongated opening defining the edge of the louvre at the leading and/or trailing edge of the fin.

* * * * *

UNITED STATES PATENT AND TRADEMARK OFFICE

CERTIFICATE OF CORRECTION

PATENT NO. : 4,328,861

DATED : May 11, 1982

INVENTOR(S) : Alex S. Cheong and Richard P. Beldam

It is certified that error appears in the above—identified patent and that said Letters Patent is hereby corrected as shown below:

Column 4, line 62, after "9." cancel "in a" and insert -- In a --.

Column 6, line 10, cancel "end/or" and insert -- and/or --.

Signed and Sealed this

*Third* Day of *August 1982*

[SEAL]

*Attest:*

GERALD J. MOSSINGHOFF

*Attesting Officer*

*Commissioner of Patents and Trademarks*